US007126114B2

(12) United States Patent
Chernushevich

(10) Patent No.: US 7,126,114 B2
(45) Date of Patent: Oct. 24, 2006

(54) METHOD AND SYSTEM FOR MASS ANALYSIS OF SAMPLES

(75) Inventor: Igor Chernushevich, North York (CA)

(73) Assignee: MDS Inc., Concord (CA)

( * ) Notice: Subject to any disclaimer, the term of this patent is extended or adjusted under 35 U.S.C. 154(b) by 0 days.

(21) Appl. No.: 11/064,089

(22) Filed: Feb. 24, 2005

(65) Prior Publication Data

US 2005/0194531 A1 Sep. 8, 2005

Related U.S. Application Data

(60) Provisional application No. 60/549,558, filed on Mar. 4, 2004.

(51) Int. Cl.
*H01J 49/40* (2006.01)

(52) U.S. Cl. ..... 250/287; 250/281; 250/282; 250/286; 250/288; 250/292

(58) Field of Classification Search ..... 250/281, 250/282, 285–287, 295, 296, 298, 396, 423 R
See application file for complete search history.

(56) References Cited

U.S. PATENT DOCUMENTS

| | | | | |
|---|---|---|---|---|
| 3,831,026 | A * | 8/1974 | Powers | 250/296 |
| 3,950,641 | A * | 4/1976 | Evans et al. | 250/283 |
| 4,099,052 | A | 7/1978 | McKinney | |
| 4,986,990 | A * | 1/1991 | Davidson et al. | 424/665 |
| 5,087,815 | A | 2/1992 | Schultz et al. | |
| 5,185,161 | A * | 2/1993 | Davidson et al. | 424/665 |
| 5,331,158 | A * | 7/1994 | Dowell | 250/287 |
| 5,426,301 | A | 6/1995 | Turner | |
| 5,614,711 | A | 3/1997 | Li | |
| 5,689,111 | A | 11/1997 | Dresch et al. | |
| 5,696,375 | A | 12/1997 | Park et al. | |
| RE36,064 | E * | 1/1999 | Davidson et al. | 424/665 |
| 6,285,027 | B1 | 9/2001 | Chernushevich et al. | |
| 6,300,626 | B1 * | 10/2001 | Brock et al. | 250/287 |
| 6,680,475 | B1 | 1/2004 | Krutchinsky | |
| 6,933,497 | B1 * | 8/2005 | Vestal | 250/287 |
| 2002/0030159 | A1 | 3/2002 | Chernushevich et al. | |
| 2003/0146392 | A1 * | 8/2003 | Kimmel et a. | 250/396 R |
| 2004/0119012 | A1 * | 6/2004 | Vestal | 250/287 |
| 2005/0230614 | A1 * | 10/2005 | Glukhoy | 250/287 |
| 2005/0258364 | A1 * | 11/2005 | Whitehouse et al. | 250/292 |

FOREIGN PATENT DOCUMENTS

| | | |
|---|---|---|
| WO | WO 99/38190 | 7/1999 |

OTHER PUBLICATIONS

M. Guilhaus, "Spontaneous and Deflected Drift-Trajectories in Orthogonal Acceleration Time-of-Flight Mass Spectrometry", 1994 American Society for Mass Spectrometry, pp. 588-595.
R.E. March, R. J. Hughes and J. F. Todd, "Quadrupole Storage Mass Spectrometry", vol. 102 of Chemical Analysis, Wiley, 1989.

* cited by examiner

*Primary Examiner*—John R. Lee
*Assistant Examiner*—Bernard E. Souw
(74) *Attorney, Agent, or Firm*—Bereskin & Parr

(57) ABSTRACT

A system and method of analyzing a sample is described. The system includes an ion source and a deflector for producing a plurality of ion beams each of which is detected in distinct detection regions. A detection system uses the information obtained from the detection region to analyze the sample.

31 Claims, 5 Drawing Sheets

60

12 kHz
62

6 kHz
64

Start pulses for
first detection region
66 spectra recorded on
first detection region
68

Start pulses for
second detection region
69 spectra recorded on
second detection region

METHOD AND SYSTEM FOR MASS ANALYSIS OF SAMPLES

FIELD OF THE INVENTION

The invention relates to analysis of samples using a time-of-flight mass analyzer.

BACKGROUND OF THE INVENTION

Mass spectrometry is a powerful method for identifying analytes in a sample. Applications are legion and include identifying biomolecules, such as carbohydrates, nucleic acids and steroids, sequencing biopolymers such as proteins and saccharides, determining how drugs are used by the body, performing forensic analyses, analyzing environmental pollutants, and determining the age and origins of specimens in geochemistry and archaeology.

In mass spectrometry, a portion of a sample is transformed into gas phase analyte ions. The analyte ions are typically separated in the mass spectrometer according to their mass-to-charge (m/z) ratios and then collected by a detector. The detection system can then process this recorded information to produce a mass spectrum that can be used for identification and quantitation of the analyte.

Time-of-flight (TOF) mass spectrometers exploit the fact that in an electric field produced in the mass spectrometer, ions acquire different velocities according to the their mass-to-charge ratio. Lighter ions arrive at the detector before higher mass ions. A time-to-digital converter or a transient recorder is used to record the ion flux. By determining the time-of-flight of an ion across a propagation path, the mass of ion can be determined.

Several methods exist for introducing the ions into the mass spectrometer. For example, electrospray ionization (ESI) offers a continuous source of ions for mass analysis. Another ionization method producing a quasi-continuous source of ions is matrix-assisted laser desorption/ionization (MALDI) with collisional cooling, sometimes referred to as "orthogonal MALDI". In orthogonal MALDI, an analyte is embedded in a solid matrix, which is then irradiated with a laser to produce plumes of analyte ions, which are cooled in collisions with neutral gas and may then be detected and analyzed.

In ESI and orthogonal MALDI TOF systems, a portion of a sample is ionized to produce a directional source beam of ions. To couple a continuous ion source to the inherently pulsed TOF mass analyzer, the orthogonal injection method is used as described, for example in (Guilhaus et al., Mass Spectrom. Rev. 19, 65–107 (2000)). A sequence of electrostatic pulses act on the source beam to produce a beam of packets of analyte ions that are then detected and analyzed according to time-of-flight methods known to those of ordinary skill. The pulses exert a force on the ions that is generally orthogonal to the direction of the source beam and that launches packets of ions towards the detector.

The timing of the pulses is important. A waiting time must elapse between pulses to ensure that the packets of ions do not interfere with each other. Thus, there is a sequence of pulsing and waiting, which continues until a sufficient number of packets are launched from the sample. The detector detects the packets and a time-of-flight analysis can be performed to discern the composition of the sample.

The waiting time between pulses must be long enough to ensure that the packets do not interfere with each other at the detection site. In particular, the waiting time must be long enough to ensure that the lighter and faster ions of a trailing packet will not pass the heavier and slower ions of a preceding packet, which would result in some overlap of the packets. For this reason, in the traditional pulse-and-wait approach, the release of an ion packet is timed to ensure that the heaviest ions of a preceding packet reach the detector before any overlap or "crosstalk" can occur, which overlap could lead to spurious mass spectra. Thus, the periods between packets are relatively long.

Aside from resulting in a longer analysis time, long waiting times between pulses also result in sample waste. In particular, in ESI and orthogonal MALDI, the production of ions is (quasi) continuous. Thus, between pulses, the production of ions by these two methods is essentially incessant. The ions that are not pulsed during the waiting time are not detected because they do not reach the detector. Consequently, the ions that are not pulsed are wasted. When the sample being tested is in short supply or is expensive, waste of the sample material can present a serious problem.

SUMMARY OF THE INVENTION

The present invention seeks to address the aforementioned waste of sample by obviating the need to wait significantly between the electrostatic pulses that act on the ions. In accordance with the method of the invention, a plurality of beams that are offset to propagate along different paths are produced. This offset ensures that each of the plurality of beams does not interfere at the detection regions.

In particular, a method and system are described for analyzing a sample. The system includes an ion source derived from the sample for producing a beam of analyte ions. The system further includes a deflector for deflecting the beam to produce at least a first beam and a second beam that are offset from each other to propagate along different paths. A first detection region detects the first beam, and a second detection region detects the second beam. The system also includes an analyzer for analyzing the sample based on the detected first and second beams.

BRIEF DESCRIPTION OF THE DRAWINGS

For a better understanding of the present invention, and to show more clearly how it may be carried into effect, reference will now be made, by way of example, to the following figures.

DETAILED DESCRIPTION OF THE INVENTION

Figure 1:
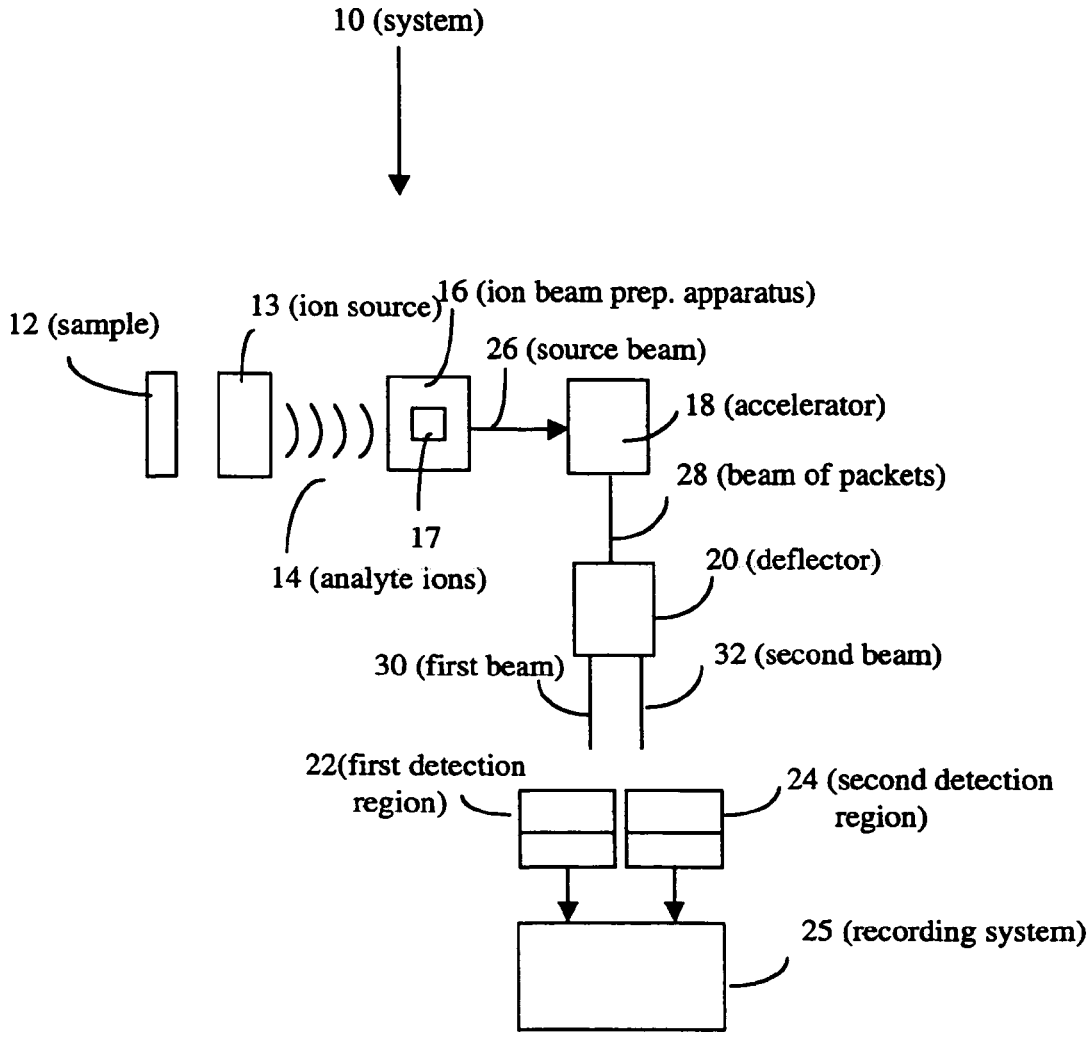
FIG. 1 shows a system for analyzing a sample according to the teachings of the present invention.

FIG. 1 shows a mass analysis system 10 for analyzing a sample 12, according to one embodiment of the present invention. The system 10 includes an ion source 13 producing analyte ions 14, an ion beam preparation apparatus 16, an accelerator 18, a deflector 20, a first detection region 22 a second detection region 24, and a recording system 25.

The ion source 13 produces ions from the sample. For example, the ion source 13 can include an ESI or an orthogonal MALDI ionizer, as known to those of ordinary skill. Analyte ions 14 from the ion source 13, which derives from the sample 12, are processed by the ion beam preparation apparatus 16 to produce a source beam 26 of analyte ions. The ion beam preparation apparatus 16 can include several components, such as a collimator 17, ion-optical electrodes (not shown), a quadrupole ion guide (not shown), an ion filter, such as a mass filter (not shown) and a collision cell (not shown).

The accelerator 18 pulses the source beam 26 with electric field pulses that exert forces on the ions of the source beam 26 that are perpendicular thereto such that the source beam 26 is pushed orthogonally as shown in FIG. 1. The electric field pulses launch packets of ions towards the deflector 20 into the drift space of the TOF mass spectrometer. In particular, the accelerator 18 launches a beam of analyte ions 28 comprising packets thereof.

The deflector 20 deflects the beam 28 to produce at least a first beam 30 and a second beam 32 that are offset from each other to propagate along different paths. The first detection region 22 detects the first beam 30, and the second detection region 24 detects the second beam 32.

The first detection region 22 and the second detection region 24 are spatially separated so that the analyte ions arriving at one do not interfere with the other. For example, the first detection region 22 and the second detection region 24 can be different segments (e.g., anodes) of one detector. Alternatively, the first detection region 22 can be a first detector and the second detection region 24 can be a separate second detector.

The recording system 25 includes software and/or hardware for analyzing the sample based on the detected first and second beams, as known to those of ordinary skill in the art. The recording system 25 can include a time-to-digital converter or transient recorder, for example, for measuring and processing signals corresponding to the arrival of analyte ions at the first detection region 22 and the second detection region 24. The arrival time of ions is measured with respect to Start signals, which are synchronized with the electric field pulses of the accelerator 18 that launches ions into the drift space of the TOF mass spectrometer.

Since two separate beams 30 and 32 are detected at two different detection regions 22 and 24, the periods during which the first beam 30 and the second beam 32 are detected can overlap without producing erroneous results. In contrast, in conventional time-of-flight analyzers containing just one detection region for detecting one beam, the first packet of ions formed from a first pulse is detected first before the second packet is detected to avoid periods of overlap, which, as previously discussed, could lead to spurious mass spectra. Such overlap error or "crosstalk" is described below in more detail with reference to FIG. 5B. In practice, a relatively long time elapses in these conventional analyzers between the pulses that launch the ion packets to ensure that there is no such overlap. If ions are generated from the sample 12 continuously, there is a waste of analyte as ions are produced during the waiting period in conventional systems that are not detected.

Figure 2:
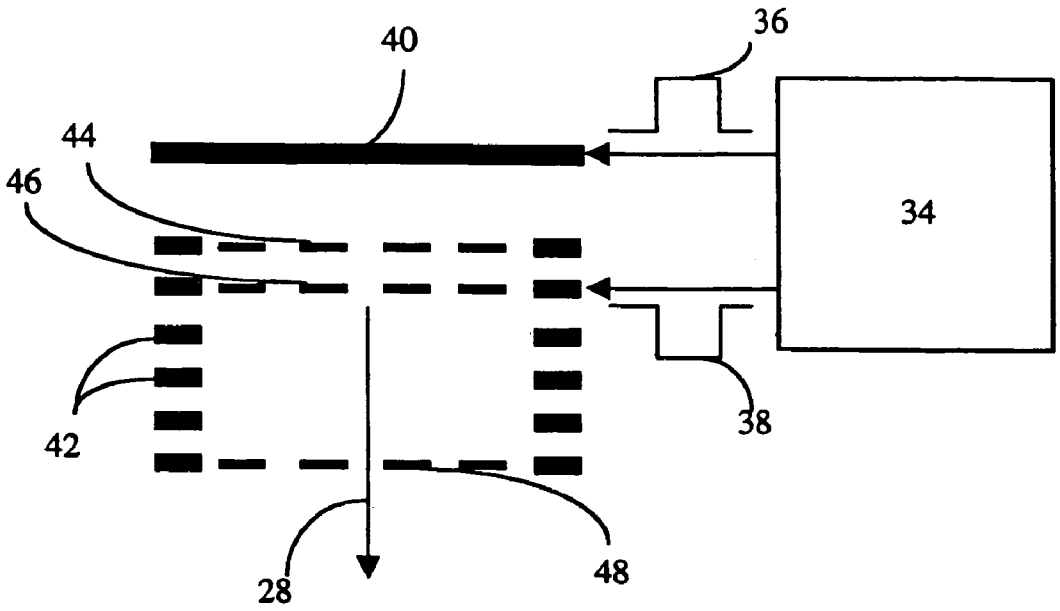
FIG. 2 shows the accelerator of FIG. 1.

FIG. 2 shows the accelerator 18 of FIG. 1. The accelerator includes a pulse generator 34, a plate 40, an accelerating column 42 comprised of rings, a first electrode grid 44, a second electrode grid 46 and a third electrode grid 48.

The pulse generator 34 creates electric field pulses 36 and 38 that "push" and "pull" the source beam 26 respectively to create a beam 28 of ion packets. Thus, if the ions are positively charged, the pulses 36 applied to plate 40 produce electric field pulses that point in the −y (down) direction. The first electrode grid 44 remains at ground potential. The pulses 38 applied to the second electrode grid 46 creates an electric field that is in the same direction as that produced by pulses 36 applied to plate 40. Thus, the pulse 36 applied to plate 40 "pushes" the ions, while the pulse 38 applied to the second electrode grid 46 "pulls" the ions. The accelerating column 42 of rings guides and accelerates the ions towards the third electrode grid 48 and the deflector 20 under the influence of a constant electric field component in the −y (downward) direction.

The description above refers to the case when positively charged ions are accelerated from (near) ground potential to large negative potential, usually of the order of several kilovolts. However, there is an alternative configuration where positively charged ions are accelerated from large positive potential to ground or zero potential. In this case, plate 40 and the first and the second electrode grids 44, 46 are floated at a high positive potential, while the third electrode grid 48 is connected to ground. Both configurations are used in practice and one of the determining factors for each configuration is dependent on which part of the TOF mass spectrometer can be conveniently isolated from ground.

Figure 3:
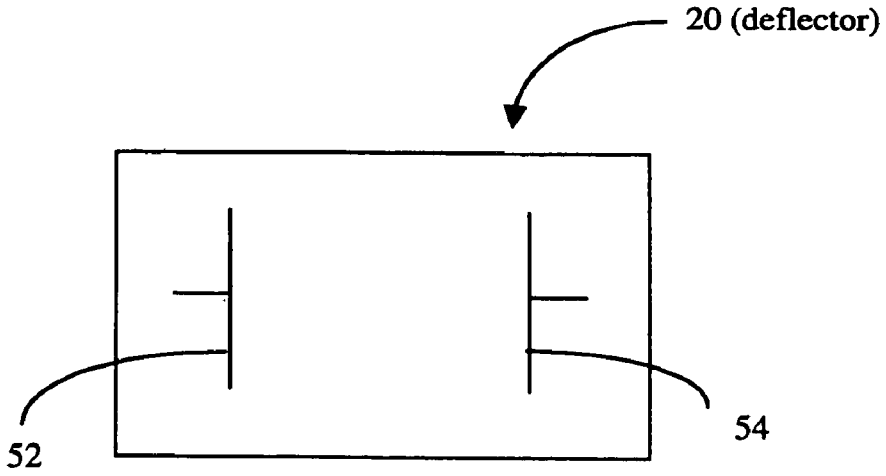
FIG. 3 shows the deflector of FIG. 1.

FIG. 3 shows the deflector 20 of FIG. 1. The deflector 20 includes a first deflector electrode 52 and a second deflector electrode 54 having a variable potential difference therebetween. A positive, negative and zero deflection state can be produced by the first deflector electrode 52 and the second deflector electrode 54. In particular, a positive state exists when the first electrode 52 is positive and the second electrode 54 is negative. A positive ion is then deflected in the +x (right) direction. A negative state exists when the first electrode 52 is negative and the second electrode 54 is positive. A positive ion is then deflected in the −x (left) direction. A zero deflection state exists when both electrodes 52 and 54 are at zero potential. Consequently, an ion does not experience a deflection when the deflector 20 is in this deflection state.

There are several ways in which the deflector 20 can deflect the beam 28 to produce the first and second beams 30 and 32. The first and second beams 30 and 32 can be produced by alternating between the positive deflection state and the negative deflection state, which results in a first beam 30 which is deflected to the right from its original path, and a second beam 32 which is deflected to the left from its original path, as shown in FIG. 1. In one embodiment, the voltage on one electrode is alternating between +2V and −2V, and on the other between −2V and +2V counterphase with the first electrode.

Alternatively, the first and second beams 30 and 32 can be produced by alternating between the positive deflection state and the zero deflection state, which results in a first beam 30 which is deflected to the right from its original path, and a second beam 32 which is undeflected. Alternatively, the first and second beams 30 and 32 can be produced by alternating between the negative deflection state and the zero deflection state, which results in a first beam 30 which is deflected to the left from its original path, and a second beam 32 which is undeflected. Other possibilities exist in which the first beam 30 is undeflected.

Figures 4A, 4B, 4C, 4D, 4E, 4F:
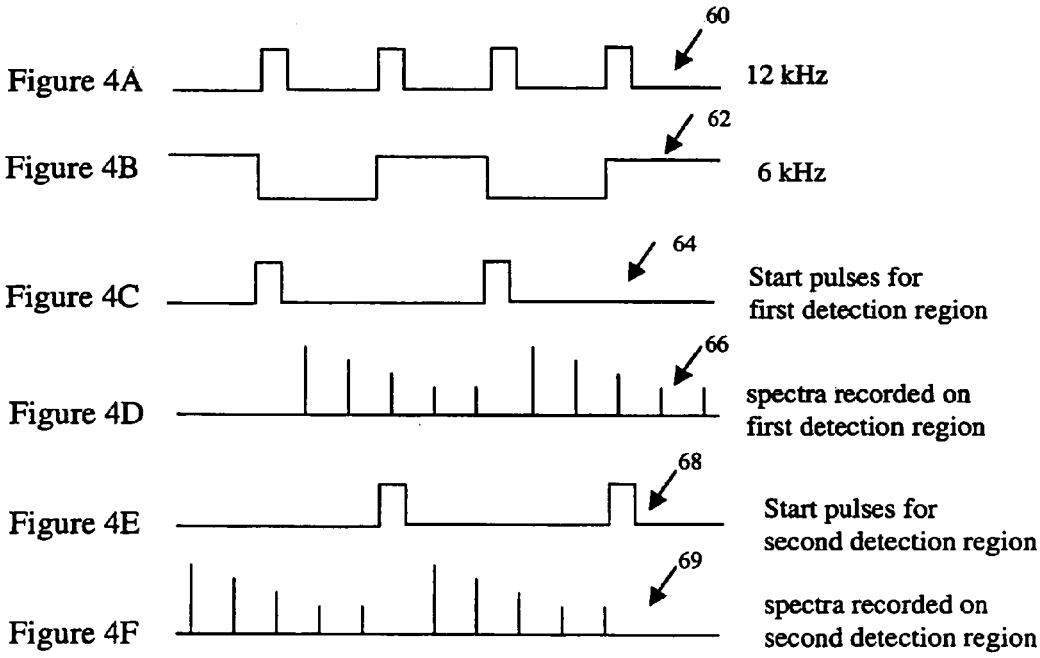
FIGS. 4A–F show timing diagrams illustrating how the accelerator, the deflector and two detection regions of FIG. 1 work in combination.

FIGS. 4A–D show timing diagrams illustrating how the accelerator 18 and the deflector 20 and the recording system 25 work in combination to produce and to analyze the first and second beams 30 and 32. FIG. 4A shows a plot 60 of the "push" pulses generated by the pulse generator 34 as a function of time. In one embodiment, the frequency of these pulses is 12 kHz. FIG. 4B shows a plot 62 of the voltage difference between the first deflector electrode 52 and the second deflector electrode 54 as a function of time. The voltage difference alternates between the negative and positive deflection states at a frequency of 6 kHz. FIG. 4C shows a plot 64 of the "Start" signals that synchronize recording of ions arriving on the first detection region 22 as a function of time. FIG. 4D shows a mass spectrum 66 of ions recorded on the first detection region 22. Because the beam 28 is deflected into two beams 32 and 34, only half of the ions pushed by the pulse generator reach the first detection region 22 and are recorded in a mass spectrum 66. Consequently, the frequency of the plot 64 is one half that of the plot 60, or 6 kHz. FIG. 4E shows a plot 68 of the Start signals that synchronize recording of ions arriving on the second detection region 24 as a function of time. FIG. 4F shows a mass spectrum 69 of ions recorded on the second detection region 24. The recording system 25 combines the signal information obtained by the first and second detection regions 22 and 24 to analyze the sample by, for example, adding (after correcting for any shifting) the mass spectra 66 and 69.

The pulses of plot 60 generate a sequence of packets, every other one being deflected by the negative voltage difference of plot 62 to the left, and the rest being deflected by the positive voltage difference of plot 62 to the right. Because the packets deflected in one direction do not interfere with the packets deflected in the other direction, the pulsing frequency is twice as great as would be appropriate without deflection. Thus, the principles of the present invention lead to increased sensitivity by combining the signal information of plots 66 and 69, and lead to faster analysis. Being able to pulse at twice the frequency also results in less waste because more ions produced from the sample 12 can be detected.

Figure 5A:
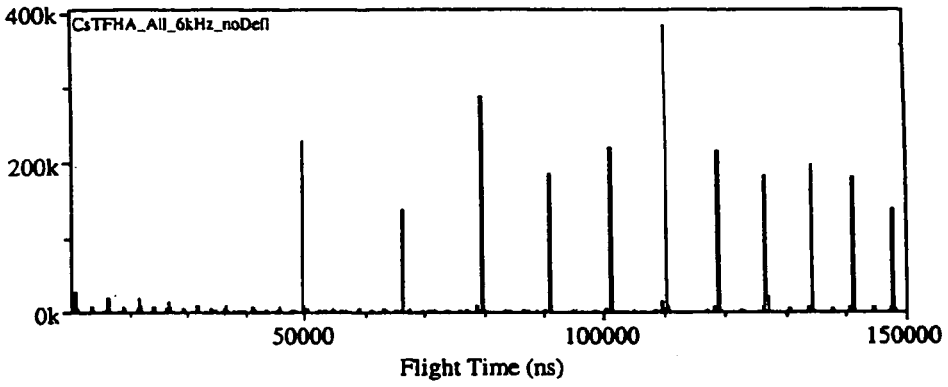
FIG. 5A shows a mass spectrum obtained using a conventional mass spectrometer with pulsing frequency 6 kHz.
Figure 5B:
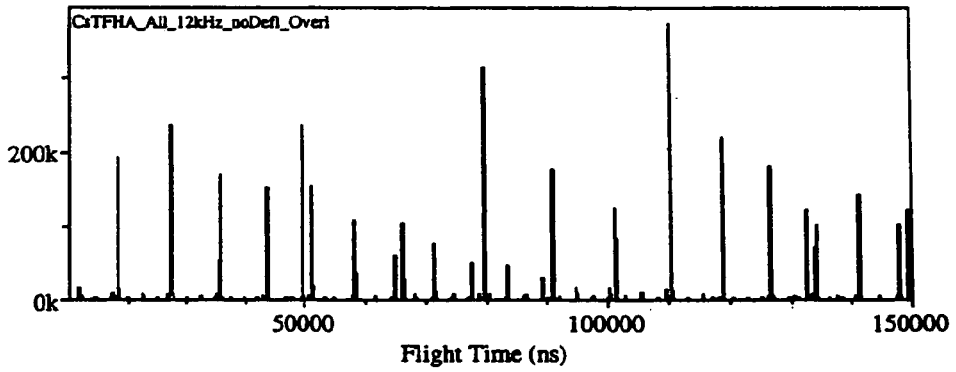
FIG. 5B shows a mass spectrum obtained using a conventional mass spectrometer with pulsing frequency 12 kHz.
Figure 5C:
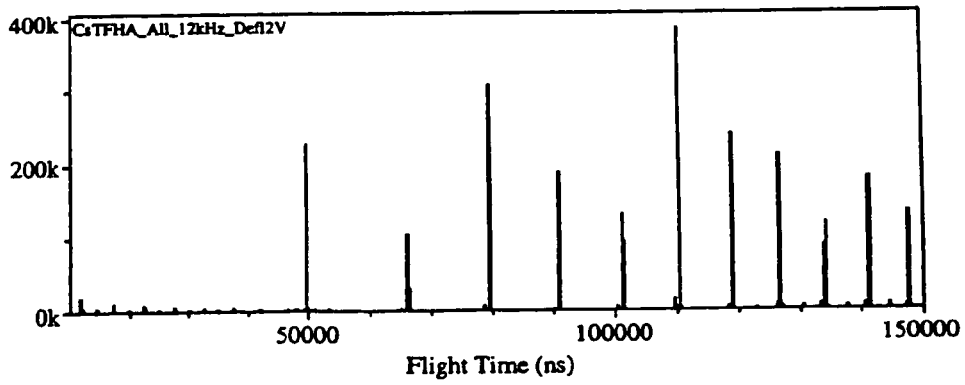
FIG. 5C shows a mass spectrum obtained using the system of the present invention with pulsing frequency 12 kHz.

FIGS. 5A and 5B show mass spectra obtained using a conventional time-of-flight mass spectrometer, such as a QSTAR® manufactured by Applied Biosystems /MDS SCIEX, and FIG. 5C shows a mass spectrum obtained from the signals received by the first detection region 22. The mass spectrum obtained by the second detection region 24 would be substantially the same.

In particular, mass spectra (plots of intensity versus flight time) are shown for a sample of CsTFHA (cesium salt of tridecafluoroheptanoic acid). FIG. 5A is a mass spectrum obtained with the conventional time-of-flight mass spectrometer having a pulsing frequency of 6 kHz corresponding to the traditional 'pulse and wait' approach. FIG. 5B is a mass spectrum obtained with the same conventional mass spectrometer, but using a 12 kHz pulsing frequency. As can be seen, there are numerous additional spectral lines in FIG. 5B that do not appear in FIG. 5A. These additional lines arise because the detection periods between pulses overlap causing crosstalk. The pulsing frequency of 12 kHz used to obtain the spectrum in FIG. 5B is too large.

FIG. 5C is a mass spectrum of the same compound obtained with a pulsing frequency of 12 kHz and the system 10 of FIG. 1. As can be seen by comparing FIG. 5A to FIG. 5C, because of the reduced overlap or crosstalk in the system of the present invention, there appears to be no additional spectra lines of the type found in FIG. 5B. Thus, using the system of the present invention affords the opportunity to sample at twice the conventional frequency without any crosstalk.

The system 10 of FIG. 1 can be varied in several ways. For example, the system 10 is linear in that a reflector (electrostatic mirror) is not used to reflect the first and second beams 30 and 32, as known to those of ordinary skill. In one variation, a reflector can be introduced into the system 10. In addition, the beam 28 can be deflected into more than two beams. Finally, the deflector 20 can be placed before the accelerator 18.

Figure 6A:
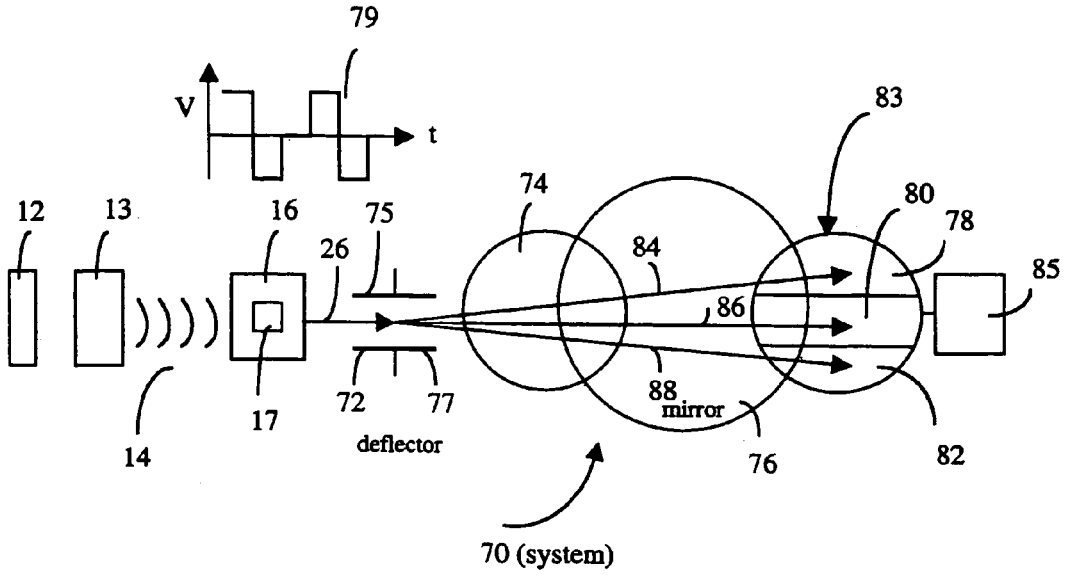
FIGS. 6A and 6B show two perspectives of another embodiment of a system for analyzing a sample according to the teachings of the present invention.
Figure 6B:
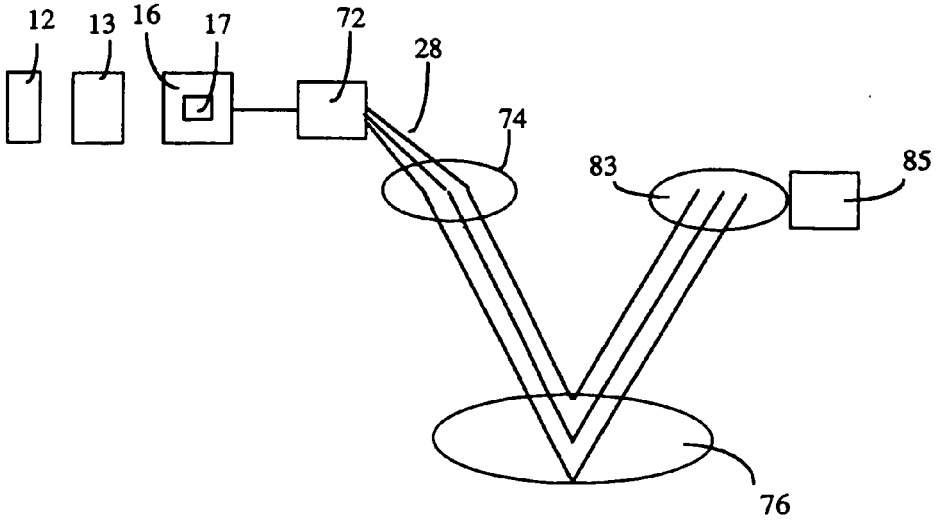

FIGS. 6A and 6B show an overhead view and a side view of a mass analysis system 70 for analyzing the sample 12 in another embodiment of the present invention incorporating these variations. In this embodiment, the source beam 26 is deflected into three ion beams and three detection regions are employed. Also, the accelerator is positioned after the deflector.

The mass analysis system 70 includes an ion source 13 producing analyte ions 14, an ion beam preparation apparatus 16, a deflector 72, an accelerator 74, a reflector (electrostatic mirror) 76, a first detection region 78, a second detection region 80, a third detection region 82 in a detecting module 83, and a recording system 85.

The ion source 13 produces ions 14 from the sample 12. For example, the ion source 13 can include an atmospheric pressure ionizer, such as an electrospray ionizer, an atmospheric pressure chemical ionizer, an atmospheric pressure photoionizer, or a MALDI ionizer such as an orthogonal MALDI ionizer, as known to those of ordinary skill. Analyte ions 14 from the ion source 13, which derives from the sample 12, are processed by the ion beam preparation apparatus 16 to produce the source beam 26 of analyte ions. The ion beam preparation apparatus 16 can include several components, such as a collimator 17, ion-optical electrodes (not shown), a quadrupole ion guide (not shown), an ion filter, such as a mass filter (not shown) and a collision cell (not shown).

The deflector 72 deflects the beam 28 to produce a first beam 84, a second beam 86 and a third beam 88 that are offset from each other to propagate along different paths. The first detection region 78 detects the first beam 84, the second detection region 80 detects the second beam 86 and the third detection region 82 detects the third beam 88.

The accelerator 74 pulses the three beams 84, 86 and 88 alternately, one at a time, with electric field pulses. The electric field pulses launch packets of ions towards the reflector 76 (off the plane of FIG. 6A). In particular, the accelerator 74 launches a beam of analyte ions 28 comprising packets thereof.

The reflector 76 helps to compensate loss of resolving power that arise due to the fact that the ions within a beam can spread spatially, resulting in the arrival time spread at the detector. To compensate for this spreading, the reflector 76, allows ions with higher kinetic energies to penetrate deeper into the device 76 than ions with lower kinetic energies and therefore stay there longer, resulting in a decrease in spread, as known to those of ordinary skill in the art.

The detecting module 83 can comprise, for example, a circular microchannel plate (MCP) 50 mm in diameter and a 3-anode detector having a 14 mm×27 mm anode detector, a 12 mm×27 mm anode detector and a 14 mm×27 mm anode detector, with each anode detector corresponding to one of the three detection regions 78, 80 and 82. Other appropriate dimensions can also be used.

The recording system 85 includes software and/or hardware for analyzing the sample based on the detected first, second and third beams 84, 86 and 88, as known to those of ordinary skill in the art. The recording system 25 can include a time-to-digital converter or transient recorder, for example, for measuring and processing signals corresponding to the arrival of analyte ions at the first detection region 78, the second detection region 80 and the third detection region 82.

A first beam 84, a second beam 86 and a third beam 88 of analyte ions are produced from the source beam 26. The deflector 74 includes a first deflector electrode 75 and a second deflector electrode 77 having a variable potential difference, V, therebetween. These electrodes 75 and 77 are capable of producing three deflection states, as described above, to deflect the source beam 26. A plot 79 showing the voltage, V, between the electrodes 75 and 77 versus time is shown in FIG. 6A. Only a portion of the periodic plot 54 is shown; the portion shown is repeated at regular intervals as corresponding packets of ions are launched. The three deflection states are shown in plot 79. In particular, the polarity changes from positive, to zero, to negative and back to positive.

Thus, the voltage between the electrodes 75 and 77 is initially negative, which deflects positive ions from the electrode with the larger potential to that with the smaller potential to produce the first beam 84. Next, the voltage between the electrodes 75 and 77 is zero, which results in no deflection of ions, resulting in the undeflected second beam 86. Finally, the voltage between the electrodes is positive, which deflects positive ions in a direction opposite to that of the first beam 84 to produce the third beam 88. In general, these beams can be produced in any order.

It should be understood that various voltage differences could be produced to create any number of deflection states and corresponding beams. Thus, other embodiments in which four or more beams are detected are consistent with the principles of the present invention.

As can be seen from the embodiments shown in FIGS. 1 and 6A and 6B, the deflector can be placed before or after the accelerator. In both cases there is a restriction regarding the relative distances between the deflector, the accelerator and the detection regions. In particular, when n beams are produced (e.g., n=3 in FIG. 6A), the distance between the deflector and the accelerator should be less than L/n, where L is the distance between the centers of the accelerator and the detection regions measured in the plane perpendicular to the axis of TOF corresponding to FIG. 6A. This is necessary to make sure that only one beam is pushed by accelerator at a time (if deflector is placed before the accelerator), or that only ions pushed by a single accelerator pulse are deflected into a single particular beam (if deflector is placed after accelerator in the drift space). For n>2, it is easier to place the deflector after the accelerator because L/n becomes too small and it is easier to move the deflector out the plane of FIG. 6A, thus positioning it after the accelerator. The choice of where to position the deflector with respect to accelerator may be dictated by several other factors:

1. Depending on the particular method of ion acceleration (from ground to high voltage, or from high voltage of the opposite polarity to ground, as discussed above), it may be more practical to position the deflector in the grounded part of the instrument;
2. The ion beams 84 and 88 deflected by the deflector before the accelerator are tilted with respect to the undeflected ion beam 86. On the other hand, if deflection happens after the accelerator, the deflected beams are parallel to each other and the undeflected beam.
3. Deflection within the drift space of TOF spectrometer is known to adversely affect mass resolution through spreading of the ion packets in the direction of TOF.

The foregoing embodiments of the present invention are meant to be exemplary and not limiting or exhaustive. For example, although emphasis has been placed on systems that produce two or three ion beams for detection, other systems capable of producing and detecting a greater number of beams are consistent with the principles of the present invention. In addition, the linear system 10 of FIG. 1 can be modified to include a reflector to minimize special spread of ions as described above. In such case, the reflector would reflect the two beams to a detecting module suitably disposed. Conversely, the system 70 could be converted to a linear system by removing the reflector and appropriately changing the location of the detecting module 83. The scope of the present invention is only to be limited by the following claims.

What is claimed is:

1. A method of analyzing a sample, the method comprising:

producing a source beam of analyte ions from the sample;

by the steps of deflecting and pulsing, generating from the source beam at least a first beam of first select packets of analyte ions and a second beam of second select packets of analyte ions, the step of deflecting to deflect the source beam with an electric field so that the at least first and second beams are offset from each other to propagate along different paths, and the step of pulsing to generate the packets of analyte ions from either the source beam or the at least first and second beams, the steps of deflecting and pulsing to generate the at least first and second select packet of analyte ions different from each other and offset from each other in both time and space;

detecting the select packets of analyte ions of the at least first and second beams in respective at least first and second detection regions; and performing a mass analysis of the sample based on the detected select packets of analyte ions.

2. The method of claim 1, wherein the source beam is pulsed to generate the packets of analyte ions before the source beam is deflected.

3. The method of claim 1, wherein the at least the first and the second beams are pulsed after the source beam is deflected.

4. The method of claim 2, wherein the source beam is pulsed to generate packets of analyte ions at an initial frequency, and the source beam is deflected, as a function of time, to generate the at least first and second beams having respective at least first and second select packets of analyte ions at respective at least first and second frequencies, and the combined at least first and second frequencies not greater than the initial frequency.

5. The method of claim 1, wherein in the step of deflecting at least one of the first and second beams is undeflected.

6. The method of claim 1, wherein in the step of deflecting all of the at least first and second beams are deflected.

7. A system for analyzing a sample, the system comprising:

an ion source derived from the sample for producing a source beam of analyte ions;

a deflector to deflect the source beam with an electric field so that the at least first and second beams are offset from each other to propagate along different paths;

a pulse generator to generate packets of analyte ions from either the source beam or the at least first and second beams, the deflector and pulse generator to generate packets of analyte ions different from each other and offset from each other in both time and space;

at least a first and second detection region to detect select packets of analyte ions from the respective at least first and second beams; and an analyzer to perform a mass analysis of the sample based on the detected select packets of analyte ions.

8. The system of claim 7, wherein the source beam is pulsed to generate the packets of analyte ions before the source beam is deflected.

9. The system of claim 7, wherein the at least the first and the second beams are pulsed after the source beam is deflected.

10. The system of claim 8, wherein the source beam is pulsed to generate packets of analyte ions at an initial frequency, and the source beam is deflected, as a function of time, to generate the at least first and second beams having respective at least first and second select packets of analyte Ions at respective at least first and second frequencies, and the combined at least first and second frequencies not greater than the initial frequency.

11. The system of claim 7, wherein the deflector is adapted to leave at least one of the first and second beams undeflected.

12. The system of claim 7, wherein the deflector is adapted to deflect all of the at least first and second beams.

13. A method of analyzing a sample with a time-of-flight mass analyzer, the method comprising:

producing a source beam of analyte ions from the sample;

by the steps of deflecting and pulsing, generating from the source beam at least a first beam of first select packets of analyte ions and a second beam of second select packets of analyte ions, the step of deflecting to deflect the source beam with an electric field so that the at least first and second beams are offset from each other to propagate along different paths, and the step of pulsing to generate the packets of analyte ions from either the source beam or the at least first and second beams, the steps of deflecting and pulsing to generate the at least first and second select packet of analyte ions different from each other and offset from each other in both time and space;

detecting the select packets of analyte ions of the at least first and second beams in respective at least first and second detection regions; and performing a mass analysis of the sample using a time of flight analyzer based on the detected select packets of analyte icons.

14. A system for analyzing a sample with a time-of-flight mass spectrometer, the system comprising:

an ion source derived from the sample for producing a source beam of analyte ions;

a deflector to deflect the source beam with an electric field so that the at least first and second beams are offset from each other to propagate along different paths;

a pulse generator to generate packets of analyte ions from either the source beam or the at least first and second beams, the deflector and pulse generator to generate the at least first and second select packets of analyte ions different from each other and offset from each other in both time and space;

at least a first and second detection region to detect select packets of analyte ions from the respective at least first and second beams; and a time of flight analyzer for analyzing the sample based on the detected select packets of analyte ions.

15. The method of claim 1, wherein producing a source beam of analyte ions from the sample includes using an ion source selected from an electrospray ionization source, an atmospheric pressure chemical ionization source or an atmospheric pressure photoionization source.

16. The method of claim 1, further comprising embedding the analyte in a matrix to produce the sample for analyzing.

17. The method of claim 16, wherein the step of producing a source beam of analyte ions includes using matrix assisted laser desorption/ionization with collisional cooling (orthogonal MALDI).

18. The method of claim 2, wherein the step of generating packets of analyte ions includes, before the step of deflecting, producing analyte ions from the sample;

collimating the analyte ions to produce the source beam; and pulsing the source beam with electric field pulses to generate a sequence of packets of analyte ions.

19. The method of claim 3, wherein the step of producing the source beam of analyte ions includes, before the step of deflecting, producing analyte ions from the sample; and collimating the analyte ions to produce the source beam of analyte ions.

20. The method of claim 19, further comprising after the step of deflecting, pulsing the at least first and second beams with electric field pulses.

21. The method of claim 1, wherein the step of performing a mass analysis includes creating a mass spectrum of the sample.

22. The system of claim 7, further comprising an ion source selected from an electrospray ionization source, an atmospheric pressure chemical ionization source or an atmospheric pressure photoionization source for producing the source beam of analyte ions.

23. The system of claim 7, further comprising a matrix for preparing the sample.

24. The system of claim 23, further comprising matrix assisted laser desorption/ionization with collisional cooling (orthogonal MALDI) apparatus for producing the source beam of analyte ions.

25. The system of claim 8, further comprising an ion beam preparation apparatus for collimating analyte ions from the ion source to produce the source beam of analyte ions, and the pulse generator for pulsing the source beam with electric field pulses, before the deflection by the deflector, to generate a sequence of packets of analyte ions.

26. The system of claim 9, further comprising an ion beam preparation system having a mass filter for filtering analyte ions from the ion source and collision cell to fragment the analyte ions to produce the source beam.

27. The system of claim 26, wherein the pulse generator for pulsing the at least first and second beams with electric field pulses after the deflection by the deflector.

28. The system of claim 7, wherein the mass analyzer is capable of creating a mass spectrum of the sample.

29. A method of analyzing a sample according to claim 13 further comprising orthogonally pulsing the source beam of analyte ions before deflecting the beam.

30. A method of analyzing a sample according to claim 13 further comprising after deflecting the source beam, orthogonally pulsing the at least first and second beams.

31. A system for analyzing a sample according to claim 14 further comprising an accelerator for pulsing the beam.

* * * * *